US008151858B2

(12) United States Patent
Hughes et al.

(10) Patent No.: US 8,151,858 B2
(45) Date of Patent: Apr. 10, 2012

(54) GARAGE SCREEN DOOR SYSTEM

(76) Inventors: Brian G. Hughes, Indian Lake Estates, FL (US); Brian E. Jones, Hoschton, GA (US)

( * ) Notice: Subject to any disclaimer, the term of this patent is extended or adjusted under 35 U.S.C. 154(b) by 64 days.

(21) Appl. No.: 12/587,860

(22) Filed: Oct. 14, 2009

(65) Prior Publication Data

US 2011/0083369 A1 Apr. 14, 2011

(51) Int. Cl.
*E06B 3/48* (2006.01)
*E05D 15/38* (2006.01)
*E05D 15/56* (2006.01)

(52) U.S. Cl. ..... 160/113; 49/197

(58) Field of Classification Search ..... 160/113, 160/115, 116, 117, 118, 201; 49/197, 201
See application file for complete search history.

(56) References Cited

U.S. PATENT DOCUMENTS

| | | | | |
|---|---|---|---|---|
| 724,472 | A * | 4/1903 | Hegbom | 49/197 |
| 3,938,577 | A * | 2/1976 | Richards | 160/90 |
| 2001/0035268 | A1* | 11/2001 | Desrochers | 160/31 |
| 2008/0115416 | A1 | 5/2008 | Clark | |
| 2008/0295979 | A1* | 12/2008 | Carlsen | 160/197 |

* cited by examiner

*Primary Examiner* — Katherine W Mitchell
*Assistant Examiner* — Jeremy Ramsey

(57) ABSTRACT

Each of two tracks are in an inverted L-shaped configuration and have a vertical section and a horizontal section. A single panel garage door is mounted for movement in the tracks between a closed orientation between the vertical sections and an open orientation between the horizontal sections. A rectangular portal is positioned within the garage door. Major screening in the garage door is at locations remote from the portal. A screen door within the portal is moveable between a closed orientation over the portal and an open orientation remote from the portal.

1 Claim, 5 Drawing Sheets

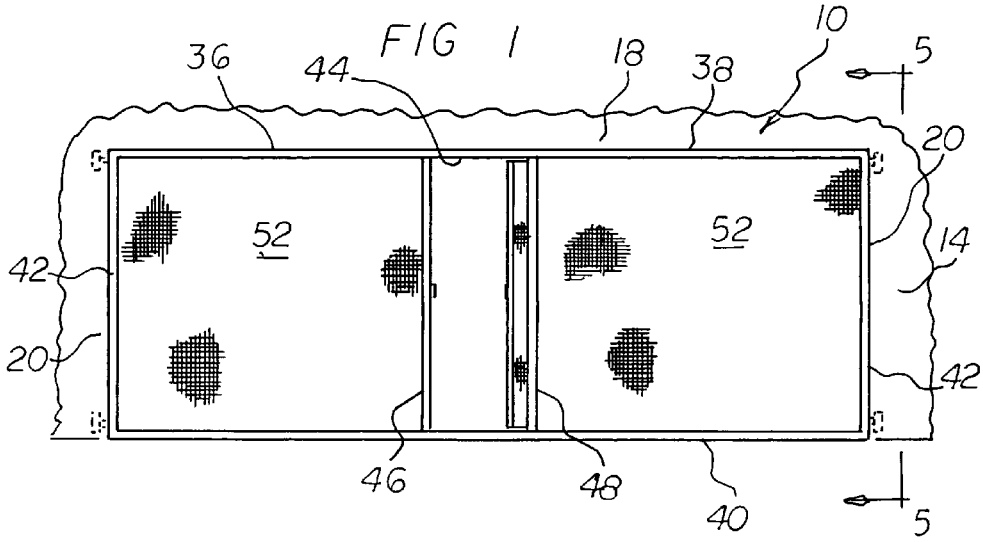
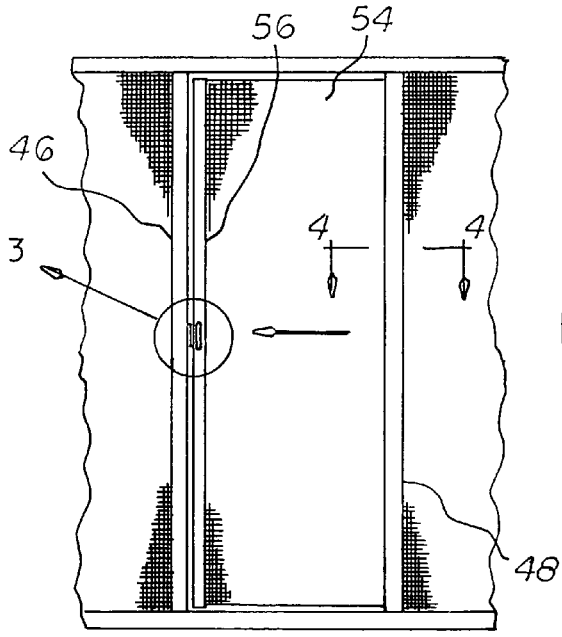
FIG 2
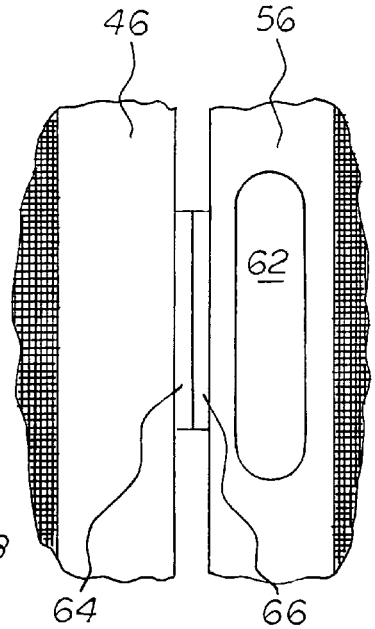
FIG 3

FIG 4
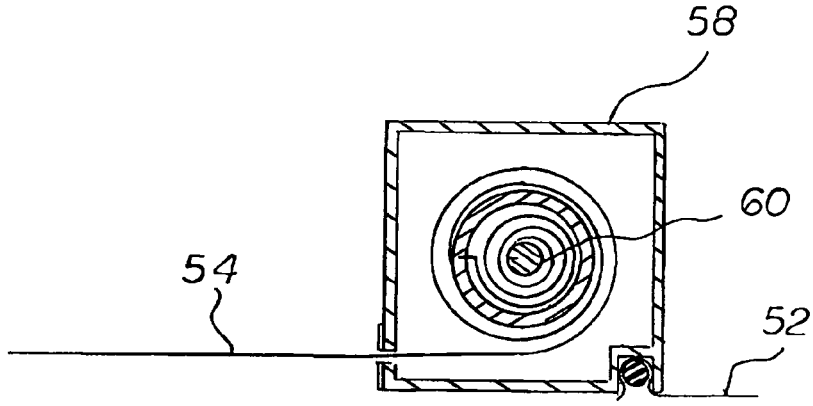
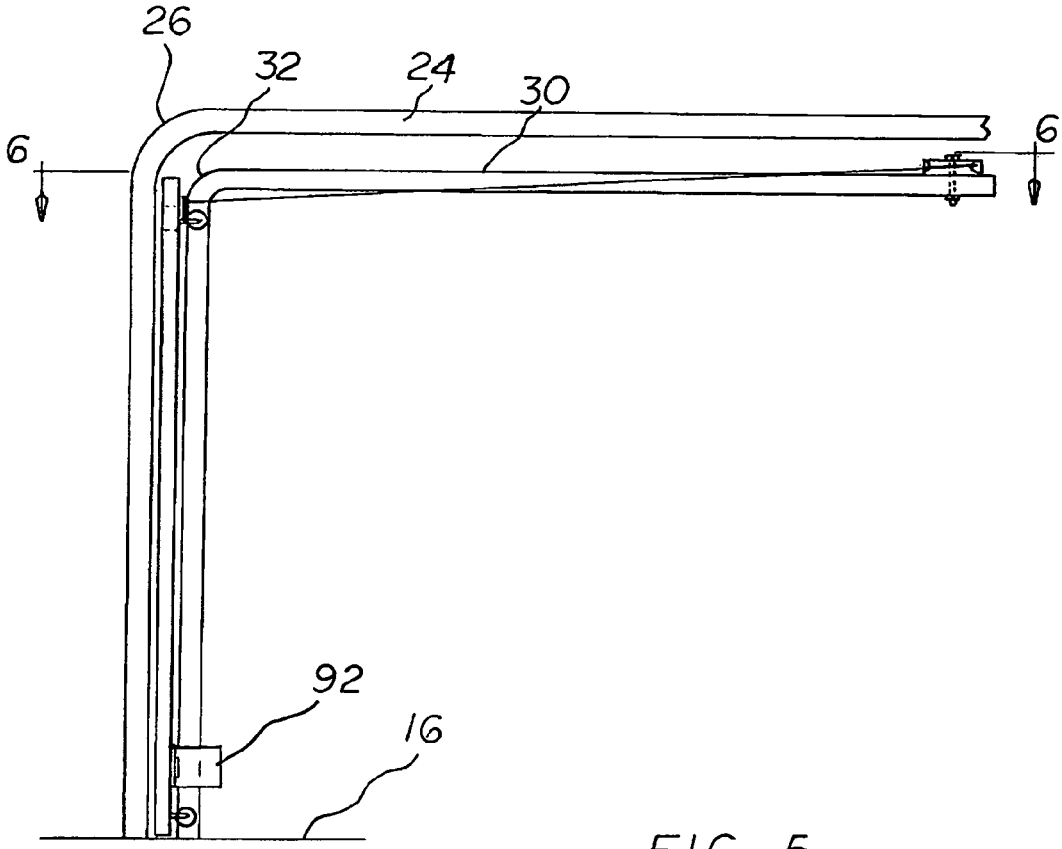
FIG 5

FIG 6
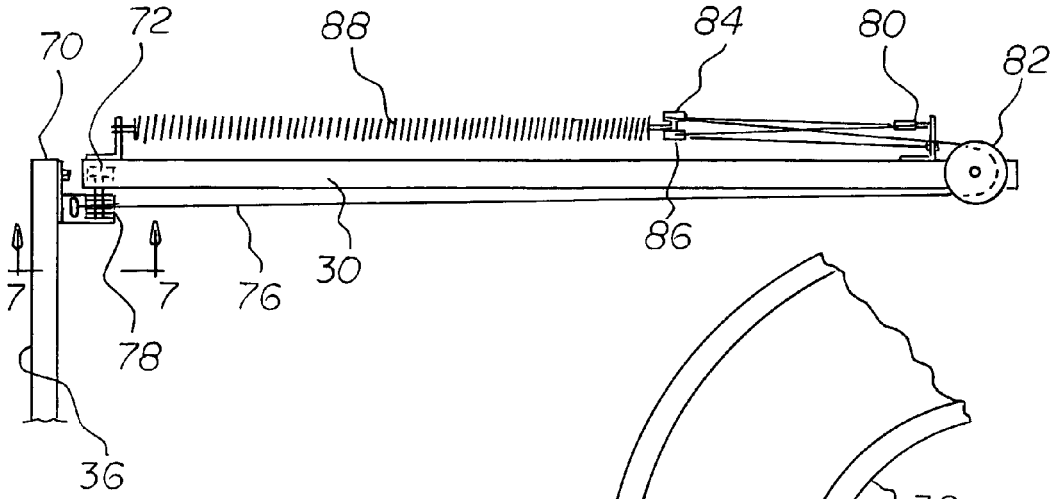
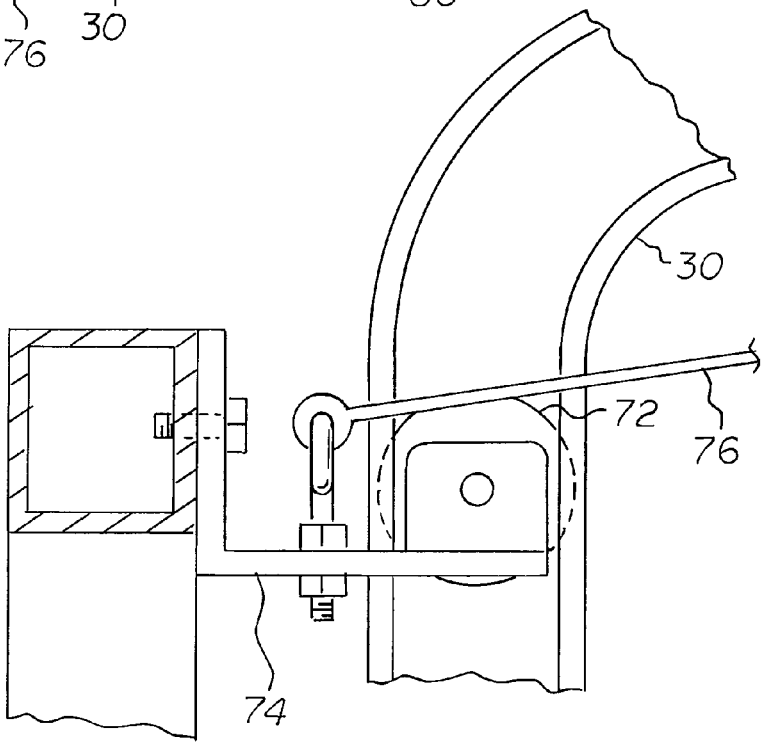
FIG 7

FIG 8
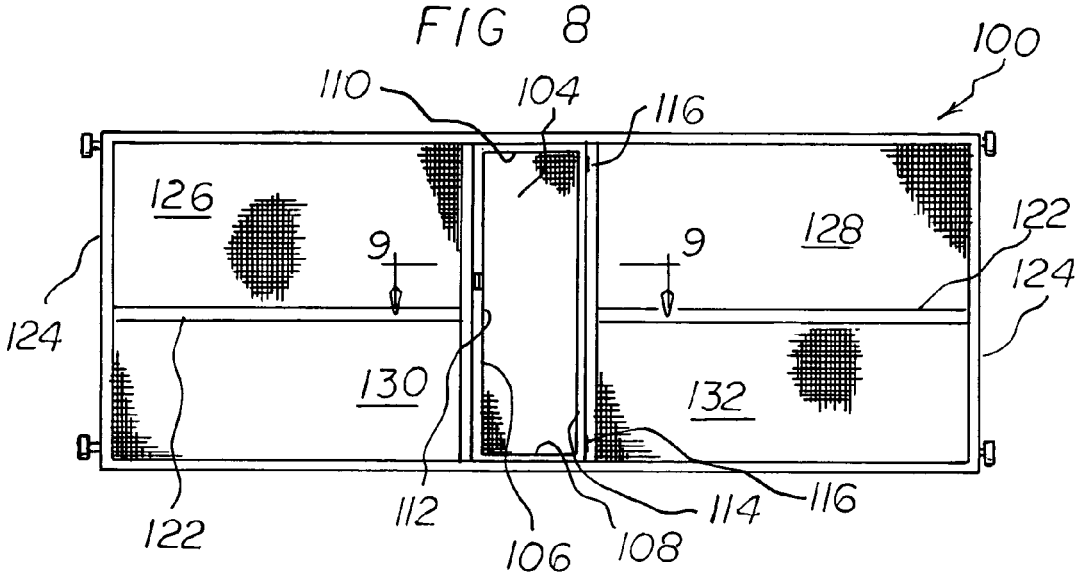
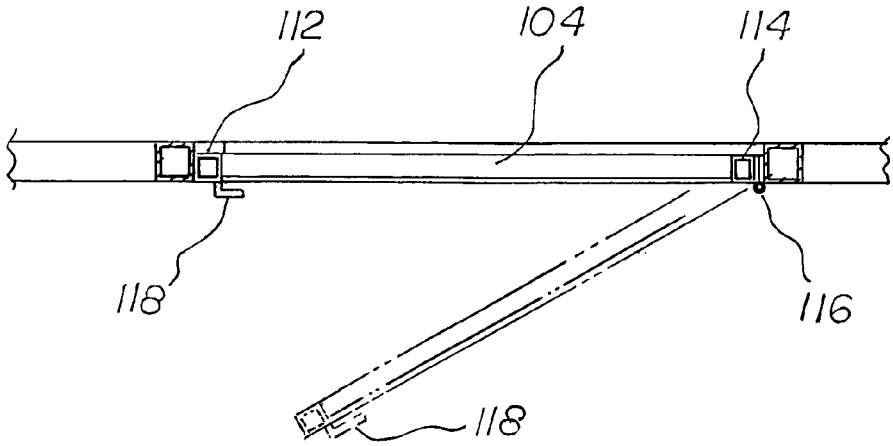
FIG 9

GARAGE SCREEN DOOR SYSTEM

BACKGROUND OF THE INVENTION

Field of the Invention

The present invention relates to a garage screen door system and more particularly pertains to providing a supplemental single panel garage door having a centrally positioned screen door, in a safe, convenient, eye-appealing and cost effective manner.

SUMMARY OF THE INVENTION

In view of the foregoing disadvantages inherent in the known types of garage door systems now present in the prior art, the present invention provides an improved garage screen door system. As such, the general purpose of the present invention, which will be described subsequently in greater detail, is to provide a new and improved garage screen door system and method which has all the advantages of the prior art and none of the disadvantages.

To attain this, the present invention essentially comprises a garage screen door system. First provided is a garage. The garage has a chamber with a front opening. The garage has a horizontal floor. The garage has a parallel ceiling. The ceiling is spaced for a door with a height of between about 6 feet and about 16 feet. The garage has vertical side walls. The side walls are spaced for a garage door with a width of between about 8 feet and about 20 feet.

Primary tracks are provided. Each track is in an inverted L-shaped configuration. Each track is mounted to a side wall. Each primary track has a vertical section within the chamber adjacent to the front opening. Each track has a horizontal section extending into the chamber. Each primary track has a curved intermediate section. The intermediate section has a radius of curvature of about 15 inches. Each primary track is adapted to receive and support a primary garage door. In this manner movement is allowed between a closed orientation between the vertical sections and an open orientation between the horizontal sections.

Secondary tracks are provided. Each secondary track is in an inverted L-shaped configuration. Each secondary track is mounted with respect to a side wall. Each secondary track has a vertical section adjacent to the front opening. Each secondary track has a horizontal section extending into the chamber depending from the primary track. Each secondary track has a curved intermediate section. The intermediate section has a radius of curvature of about 4 inches. The secondary track with its intermediate section is radially interior of and spaced a common distance from the primary track.

Provided next is a single panel secondary garage door. The secondary garage door has upper and lower rails. The secondary garage door has side rails. The rails are mounted for movement in the secondary tracks between a closed orientation between the vertical sections and an open orientation between the horizontal sections.

A rectangular portal is provided next. The rectangular portal is centrally positioned within the secondary garage door. First and second vertical door rails are provided. In this manner the lateral extent of the portal and central extents of the upper and lower rails define the elevational extent of the portal.

Major screens are provided. The major screens are secured laterally between one of the side rails and an adjacent vertical door rail. Each major screen is secured elevationally between the upper and lower rails at locations remote from the portal.

Further provided is a screen door. The screen door is formed of a flexible screen. The screen door has a height essentially equal to the height of the portal. The screen door has a width greater than the width of the portal. The flexible screen has an exterior end. The exterior end has a vertical support. The screen door has an interior end. A vertical housing is provided. The vertical housing is coupled with the second vertical door rail. The housing has a spring loaded spool. The spool receives the flexible screen. In this manner movement of the flexible screen between a closed orientation covering the portal and an open orientation within the housing is allowed. The vertical support has a handle. The vertical support encompasses the spool. In this manner the opening and closing the screen door is facilitated. The first vertical door rail and the vertical support have magnets. In this manner the flexible screen is maintained in a closed orientation.

Provided next is a lifting assembly for the secondary garage door. The lifting assembly includes a 2 inch roller. The 2 inch roller extends outwardly with respect to each end of the upper and lower rails. The rollers are received for movement within the secondary tracks. The lifting assembly includes a first bracket. The first bracket couples the upper rail and one of the rollers. The lifting assembly includes a cable. The cable has a first end. The first end is coupled to the first bracket. The cable has a second end. The second end is laterally secured with respect to the horizontal section of the secondary track remote from the front opening. The lifting assembly includes a major pulley. The lifting assembly includes secondary pulleys. The pulleys guide the movement of the screen door when lifting and lowering. The lifting assembly also includes a coil spring. The coil spring couples the secondary pulleys with respect to the horizontal section of the secondary track adjacent to the front opening. In this manner the strength needed to lift and lower the secondary garage door is minimized.

Lastly provided is a beam deflector secured to the secondary garage door adjacent to one side of the lower rail. The beam deflector is adapted to disrupt an electric eye light beam normally extending close to the floor from one side wall of the garage to the other side wall adjacent to the opening. This is a safety measure to preclude interference between the primary garage door and secondary garage door while moving between the open and closed orientations.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved garage screen door system which has all of the advantages of the prior art garage screen door systems and none of the disadvantages.

It is another object of the present invention to provide a new and improved garage screen door system which may be easily and efficiently manufactured and marketed.

It is further object of the present invention to provide a new and improved garage screen door system which is of durable and reliable constructions.

An even further object of the present invention is to provide a new and improved garage screen door system which is susceptible of a low cost of manufacture with regard to both materials and labor, and which accordingly is then susceptible of low prices of sale to the consuming public, thereby making such garage screen door system economically available to the buying public.

Even still another object of the present invention is to provide a garage screen door system for providing a supplemental single panel garage door having a centrally positioned screen door, in a safe, convenient, eye-appealing and cost effective manner.

Lastly, it is an object of the present invention to provide a new and improved garage screen door system. Two tracks are provided. Each track is in an inverted L-shaped configuration. Each track has a vertical section and a horizontal section. A single panel garage door is mounted for movement in the tracks between a closed orientation between the vertical sections and an open orientation between the horizontal sections. A rectangular portal is positioned within the garage door. Major screening in the garage door is provided at locations remote from the portal. A screen door within the portal is moveable between a closed orientation over the portal and an open orientation remote from the portal.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated a primary and preferred embodiment of the invention as well as an alternate embodiment of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a garage screen door system constructed in accordance with the principles of the present invention.

FIG. 2 is an enlarged front elevational view of the central portion of the system shown in FIG. 1 but with the screen door closed.

FIG. 3 is an enlarged front elevational view of the central portion of the system taken at Circle 3 of FIG. 2.

FIG. 4 is a cross sectional view taken at line 4-4 of FIG. 2.

FIG. 5 is an end elevational view of the system taken along line 5-5 of FIG. 1.

FIG. 6 is a plan view of the system taken along line 6-6 of FIG. 5.

FIG. 7 is a cross sectional view taken at line 7-7 of FIG. 6.

FIG. 8 is a front elevational view similar to FIG. 1 but illustrating an alternative embodiment of the invention.

FIG. 9 is a plan view taken at line 7-7 of FIG. 6 but with the door, shown in broken lines, in an open orientation.

The same reference numerals refer to the same parts throughout the various Figures.

DESCRIPTION OF THE PREFERRED EMBODIMENT

Figure 10:
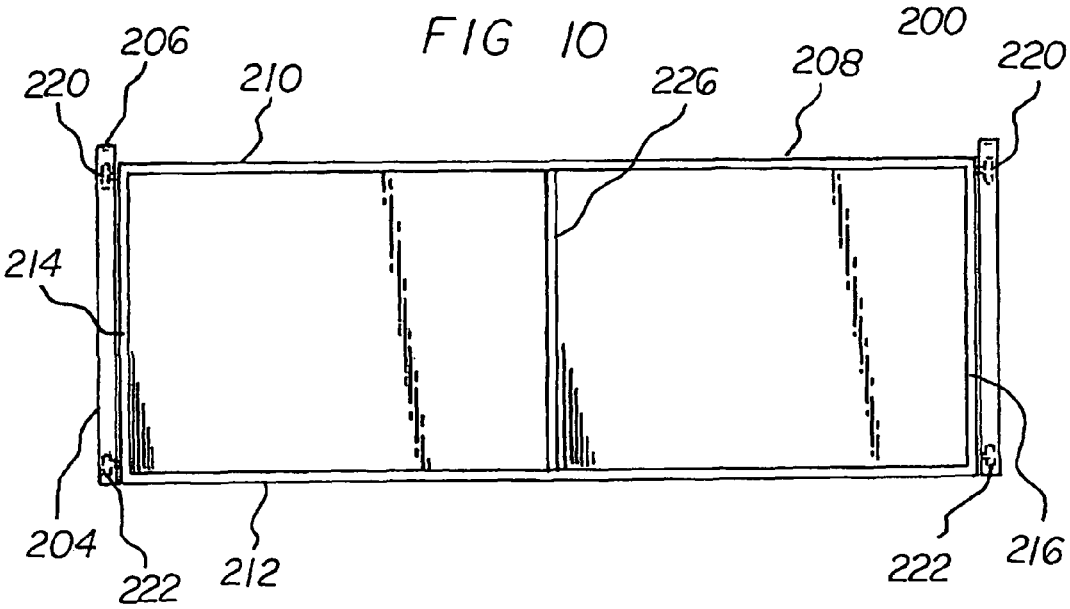
FIG. 10 is front elevational view of a garage door system constructed in accordance with another alternate embodiment of the invention.

With reference now to the drawings, and in particular to FIG. 1 thereof, the preferred embodiment of the new and improved garage screen door system embodying the principles and concepts of the present invention and generally designated by the reference numeral 10 will be described.

The present invention, the garage screen door system 10 is comprised of a plurality of components. Such components in their broadest context include two vertical tracks, a single panel garage door, a rectangular portal and a screen door. Such components are individually configured and correlated with respect to each other so as to attain the desired objective.

First provided is a garage 14. The garage has a chamber with a front opening. The garage has a horizontal floor 16. The garage has a parallel ceiling 18. The ceiling is spaced for a garage door with a height of between about 6 feet and about 16 feet. The garage has vertical side walls 20. The side walls are spaced for a garage door with a width of between about 8 feet and about 20 feet.

Primary tracks 24 are provided. Each track is in an inverted L-shaped configuration. Each track is mounted to a side wall. Each primary track has a vertical section within the chamber adjacent to the front opening. Each track has a horizontal section extending into the chamber. Each primary track has a curved intermediate section 26. The intermediate section has a radius of curvature of about 15 inches. Each primary track is adapted to receive and support a primary garage door. In this manner movement is allowed between a closed orientation between the vertical sections and an open orientation between the horizontal sections.

Secondary tracks 30 are provided. Each secondary track is in an inverted L-shaped configuration. Each secondary track is mounted with respect to a side wall. Each secondary track has a vertical section adjacent to the front opening. Each secondary track has a horizontal section extending into the chamber and depending from the primary track. Each secondary track has a curved intermediate section 32. The intermediate section has a radius of curvature of about 4 inches. The secondary track with its intermediate section is radially interior of and spaced a common distance from the primary track.

Provided next is a single panel secondary garage door 34. The secondary garage door has upper and lower rails 38,40. The secondary garage door has side rails 42. The rails are mounted for movement in the secondary tracks between a closed orientation between the vertical sections and an open orientation between the horizontal sections.

A rectangular portal 44 is provided next. The rectangular portal is centrally positioned within the secondary garage door. First and second vertical door rails 46, 48 are provided. In this manner the lateral extent of the portal and central extents of the upper and lower rails define the elevational extent of the portal.

Major screens 52 are provided. The major screens are secured laterally between one of the side rails and an adjacent vertical door rail. Each major screen is secured elevationally between the upper and lower rails at locations remote from the portal.

Further provided is a screen door 54. The screen door is formed of a flexible screen. The screen door has a height essentially equal to the height of the portal. The screen door has a width greater than the width of the portal. The flexible screen has an exterior end. The exterior end has a vertical support 56. The screen door has an interior end. A vertical housing 58 is provided. The vertical housing is coupled with the second vertical door rail. The housing has a spring loaded spool 60. The spool receives the flexible screen. In this manner movement of the flexible screen between a closed orientation covering the portal and an open orientation within the housing is allowed. The vertical support has a handle 62. The vertical support encompasses the spool. In this manner the opening and closing the screen door is facilitated. The first vertical door rail and the vertical support have magnets 64, 66. In this manner the flexible screen is maintained in a closed orientation.

Provided next is a lifting assembly 70 for the secondary garage door. The lifting assembly includes a 2 inch roller 72. The 2 inch roller extends outwardly with respect to each end of the upper and lower rails. The rollers are received for movement within the secondary tracks. The lifting assembly includes a first bracket 74. The first bracket couples the upper rail and one of the rollers. The lifting assembly includes a cable 76. The cable has a first end 78. The first end is coupled to the first bracket. The cable has a second end 80. The second end is laterally secured with respect to the horizontal section of the secondary track remote from the front opening. The lifting assembly includes a major pulley 82. The lifting assembly includes secondary pulleys 84, 86. The pulleys guide the movement of the screen door when lifting and lowering. The lifting assembly also includes a coil spring 88. The coil spring couples the secondary pulleys with respect to the horizontal section of the secondary track adjacent to the front opening. In this manner the strength needed to lift and lower the secondary garage door is minimized.

Lastly provided is a beam deflector 92 secured to the secondary garage door adjacent to one side of the lower rail. The beam deflector is adapted to disrupt an electric eye light beam normally extending close to the floor from one side wall of the opening to the other side wall of the opening. This is for functioning as a safety measure to preclude interference between the primary garage door and secondary garage door while moving between the open and closed orientations.

Reference in now made to the alternate embodiment 100 of the invention as illustrated in FIGS. 8 and 9. A screen door 104 is provided. The screen door is in a rectangular configuration. The screen door includes a frame 106. The frame has a horizontal lower rail 108. The frame has a parallel upper rail 110. The upper and lower rails are spaced by a height essentially equal to the height of the portal. The frame has vertical side rails 112, 114. The side rails couple the upper and lower rails. The side rails are spaced by a width essentially equal to the width of the portal. The frame further includes hinges 116. The hinges pivotally couple the screen door to the garage door. The screen door has a handle 118. In this manner opening and closing of the screen door is facilitated.

A chair rail 122 is provided. An end rail 124 is provided. The chair rail is horizontally supported on the garage door between the end rail and an adjacent vertical side rail of the frame. The major screening is in four sections. Two sections 126, 128 are located on each vertical side rail of the frame above the chair rail. Two sections 130, 132 are located on each vertical side rail of the frame below the chair rail.

FIG. 10 illustrates another embodiment of the invention. In such embodiment, a garage door system 200 is provided.

Such garage door system comprises two laterally spaced tracks. Each track is formed in an inverted L-shaped configuration with a vertical section 204 and a horizontal section 206.

A single panel garage door 208 is next provided. Such garage door has a rigid peripheral frame formed with a horizontal upper rigid rail 210 and a parallel lower rigid rail 212 and laterally spaced side rigid rails 214, 216 between the upper and lower rigid rails. The garage door is adapted to be fabricated of any suitable material with or without windows.

A pair of upper rollers 220 extend outwardly from adjacent to the upper rigid rail. A pair of lower rollers 222 extend outwardly from adjacent to the lower rigid rail. The two pair of rollers are sideably received in the tracks.

Lastly, a divider rail 226 extends between the upper and lower rigid rails parallel with the side rigid rails. The divider rail is adapted to be used in the installation of a service door which may later be formed in the garage door. Like the garage door, the service door is adapted to be fabricated of any suitable material.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A garage screen door system for providing a supplemental single panel garage door having a centrally positioned screen door, the system comprising, in combination:

a garage having a chamber with a front opening, the garage having a horizontal floor and a parallel ceiling spaced for a garage door with a height of between about 6 feet and about 16 feet, the garage having vertical side walls spaced for a door with a width of between about 8 feet and about 20 feet;

primary tracks, each track being in an inverted L-shaped configuration and mounted to a side wall, each primary track having a vertical section within the chamber adjacent to the front opening and a horizontal section extending into the chamber, each primary track having a curved intermediate section with a radius of curvature of about 15 inches, the primary tracks adapted to receive and support a primary garage door for movement between a closed orientation between the vertical sections and an open orientation between the horizontal sections;

secondary tracks, each secondary track being in an inverted L-shaped configuration and mounted with respect to a side wall, each secondary track having a vertical section adjacent to the front opening and a horizontal section extending into the chamber and depending from the primary track, each secondary track having a curved intermediate section with a radius of, curvature of about 4 inches, the secondary track with its vertical, intermediate and horizontal sections, all being radially interior of and spaced from the primary track;

a single panel secondary garage door having upper and lower rails and side rails mounted for movement in the secondary tracks between a closed orientation between the vertical sections and an open orientation between the horizontal sections, the single panel secondary garage door when in the closed orientation adapted to cover the entire front opening of the garage;

a rectangular portal centrally positioned within the secondary garage door, first and second vertical door rails, defining the lateral extent of the portal and central extents of the upper and lower rails defining the elevational extent of the portal;

major screens secured laterally between one of the side rails and an adjacent vertical door rail, each major screen secured elevationally between the upper and lower rails at locations remote from the portal;

a small screen door formed of a flexible screen having a height essentially equal to the height of the portal and having a width greater than the width of the portal, the flexible screen having an exterior end with a vertical support, the small screen door having an interior end, a vertical housing coupled with the second vertical door rail, the housing having a spring loaded spool receiving the flexible screen for movement of the flexible screen between a closed orientation covering the portal and an open orientation within the housing, the vertical support having a handle and encompassing the spool to facilitate opening and closing the small screen door, the first vertical door rail and the vertical support having magnets for retaining the flexible screen in a closed orientation;

a lifting assembly for the secondary garage door, the lifting assembly including a 2 inch roller extending outwardly with respect to each end of the upper and lower rails, the rollers received for movement within the secondary tracks, a first bracket coupling the upper rail and one of the rollers, a cable having a first end coupled to the first bracket, the cable having a second end laterally secured with respect to the horizontal section of the secondary track remote from the front opening, a major pulley and secondary pulleys guiding the movement of the secondary garage door when lifting and lowering, the lifting assembly also including a coil spring coupling the secondary pulleys with respect to the horizontal section of the secondary track adjacent to the front opening to minimize the strength needed to lift and lower the secondary garage door; and a beam deflector secured to the secondary garage door adjacent to one side of the lower rail and adapted to disrupt an electric eye light beam normally extending close to the floor from one side wall of the opening to the other side wall of the opening as a safety measure to preclude interference between the primary garage door and secondary garage door while each of the primary and secondary garage doors are moving between their respective to open and closed orientations.

* * * * *